US008074715B2

(12) United States Patent
Rispler et al.

(10) Patent No.: US 8,074,715 B2
(45) Date of Patent: Dec. 13, 2011

(54) METHODS OF SETTING PARTICULATE PLUGS IN HORIZONTAL WELL BORES USING LOW-RATE SLURRIES

(75) Inventors: Keith A. Rispler, Red Deer (CA); Loyd E. East, Tomball, TX (US); Bradley L. Todd, Duncan, OK (US); David E. McMechan, Duncan, OK (US); Corine McMechan, legal representative, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 459 days.

(21) Appl. No.: 12/354,551

(22) Filed: Jan. 15, 2009

(65) Prior Publication Data

US 2010/0175878 A1 Jul. 15, 2010

(51) Int. Cl.
*E21B 33/12* (2006.01)
*E21B 33/134* (2006.01)

(52) U.S. Cl. ..... 166/285; 166/192; 166/280.1

(58) Field of Classification Search ..... 166/192, 166/280.1, 281, 284, 285, 293, 308.1, 308.5
See application file for complete search history.

(56) References Cited

U.S. PATENT DOCUMENTS 3,155,159 A * 11/1964 McGuire et al. ..... 166/280.1
6,070,666 A * 6/2000 Montgomery ..... 166/308.1
7,017,664 B2 3/2006 Walker et al.
7,225,869 B2 6/2007 Willett et al.
7,273,099 B2 9/2007 East, Jr. et al.
7,398,825 B2 7/2008 Nguyen et al.
7,690,427 B2 * 4/2010 Rispler ..... 166/293
2004/0094299 A1 * 5/2004 Jones ..... 166/285
2008/0070808 A1 3/2008 Munoz et al.
2008/0271889 A1 * 11/2008 Misselbrook et al. ..... 166/280.1
2010/0212906 A1 * 8/2010 Fulton et al. ..... 166/308.5

FOREIGN PATENT DOCUMENTS

WO WO 2007/060389 A1 5/2007
WO WO 2007/141465 A1 12/2007

OTHER PUBLICATIONS

BioVert™ H150 Diverter and Fluid Loss Control Material product brochure, Jul. 2008.
CobraMax® H Fracturing Service product brochure, Oct. 2007.
Delta Frac® Service product brochure, Jul. 2005.

(Continued)

*Primary Examiner* — Daniel P Stephenson
(74) *Attorney, Agent, or Firm* — Robert A. Kent; McDermott Will & Emery LLP

(57) ABSTRACT

Methods for setting particulate plugs in at least partially horizontal sections of well bores are disclosed. In one embodiment, a method comprises the step of selecting a deposition location for a particulate plug within the at least partially horizontal section of the well bore. The method further comprises the step of providing a pumping conduit capable of delivering slurries to the deposition location. The method further comprises the step of pumping a first slurry through the pumping conduit to the deposition location such that a velocity of the first slurry in the well bore at the deposition location is less than or equal to the critical velocity of the first slurry in the well bore at the deposition location.

17 Claims, 10 Drawing Sheets

OTHER PUBLICATIONS

"Hydraulic Fracturing Slurry Transport in Horizontal Pipes," Shah, S.N., Lord, D.L., SPE Drilling Engineering, Sep. 1990.
N-DRIL™ HT PLUS product brochure, Mar. 2008.
SeaQuest[SM] Service product brochure, May 2005.
"Multiple Proppant Fracturing of Horizontal Wellbores in a Chalk Formation: Evolving the Process in the Valhall Field," Norris, M.R. et al., SPE 50608, Oct. 1998.
SurgiFrac[SM] Service product brochure, Aug. 2005.
"The Critical Velocity in Pipeline Flow of Slurries," Oroskar, A.R., Turian, R.M., AIChE Journal, vol. 26, No. 4, Jul. 1980.
fann® Model 35 Viscometer product brochure, 2007.
WG-11™ Gelling Agent product brochure, Jan. 2008.
International Search Report and Written Opinion for PCT/GB2010/000052 dated Jun. 1, 2010.
Chambers, M.J.: Laying Sand Plugs with Coiled Tubing; Mar. 21, 1993, pp. 809-817, XP002582446, SPE 25496.
Norris, M.R. et al.: Multiple Proppant Fracturing of Horizontal Wellbores in a Chalk Formation Evolving the Process in the Valhall Field; Oct. 20, 1998, pp. 335-349, XP002582447, SPE 50608.

* cited by examiner

METHODS OF SETTING PARTICULATE PLUGS IN HORIZONTAL WELL BORES USING LOW-RATE SLURRIES

BACKGROUND

The present invention relates to setting particulate plugs in horizontal well bores, and more particularly, in certain embodiments, to methods involving low-rate pumping of slurries.

In both vertical and horizontal well bores, it is frequently desirable to treat a subterranean formation at various locations of interest along the length of the well bore. In general, a well bore may penetrate various reservoirs, intervals, or other zones of interest. In some instances, the length or extent of an interval may make it impractical to apply a single treatment to the complete interval. When treating a reservoir from a well bore, especially from well bores that are deviated, horizontal, or inverted, it is difficult to control the creation of multi-zone fractures along the well bore without cementing a liner to the well bore and mechanically isolating the zone being treated from either previously treated zones or zones not yet treated.

At various points in treatment of a well bore, plugs may be useful, inter alia, to isolate a zone of interest. The creation of an interval zone with the use of one or more plugs may provide for distinct, sequential treatments of various zones of interest. Plugs may comprise valves, mechanical devices such as packers, and/or liquid or solid barriers, e.g., a plug made of particulates. Typically, particulate plugs have been created only in vertical well bores, due to difficulties encountered in creating particulate plugs in deviated, horizontal, or inverted well bores.

Generally, well bores may be cased or uncased through treatment zones. For example, a cased, vertical well bore may be perforated through a first, lower zone of interest. A pumping conduit may then be extended into the well bore to a depth above the first zone of interest, and a packer may be positioned to prevent the flow of fracturing fluid upwardly between the outside of the conduit and the inside of the casing. A fracturing fluid may then be injected into the vertical well bore to fracture the formation through the perforations or, in the situation of an uncased well bore, through a notched area of the formation of interest. After the fracturing is completed, a particulate plug may be positioned over the fractured formation by filling the well bore with particulates to a suitable level. Thereafter, a formation above the particulate plug may be perforated and fractured by the same technique. By the use of particulate plugs of a variety of depths, a plurality of formations in a vertical well bore may be fractured independently of one another. Typically, each zone is perforated separately so that the particulate plug effectively isolates all the zones below the zone being treated. Zones above the zone being treated are typically perforated subsequently or are isolated from the zone being treated by the packer.

In horizontal well bores, by contrast, particulate plugs typically have not been readily usable. In some instances, a particulate plug may generally slump and expose the perforations and/or fractures in a previously treated zone to the fluid pressure imposed to treat a location uphole from the previously treated zone.

Typically, pairs of packers or other mechanical isolation devices have been used to isolate treatment zones in a section of a well bore that is deviated, horizontal, or inverted. The packers may be carried into the well on a tubing or other suitable work string. The first packer may be set downhole of the treatment zone, and the second packer may be set uphole of the treatment zone. The treatment fluid may thereafter be placed into the treatment zone between the two packers to treat the horizontal well bore at the desired location. A plurality of zones in the horizontal well bore may be readily treated using this technique, but it is a relatively expensive and complicated technique. Alternatively, treatments of horizontal well bores have utilized traditional methods of gravel packing. As used herein, "gravel packing" refers to the pumping and placement of a quantity of desired particulates into the unconsolidated formation in an area adjacent the well bore. Such procedures may be time consuming and costly for formations with multiple treatment zones in horizontal sections of the well.

Setting particulate plugs in horizontal well bores is generally challenging. Traditional methods of setting particulate plugs in a vertical well bore may not be directly transferable to a horizontal well bore. For example, setting a particulate plug in a previous treatment zone of a horizontal well bore may require that the particulate plug have sufficient height to create a bridge across either a perforation or casing. However, a low concentration slurry—as is generally required to provide a pumpable slurry—may only partially fill a horizontal well bore due to gravity-induced settling. Moreover, if the well bore is cased, insufficient leak-off may hamper particulate deposition.

Previous attempts to set particulate plugs in horizontal well bores have been limited by the pumpable densities of the slurry and the resulting effective height of the particulate plug. For example, slurries with excessive densities may result in particulate deposits within the pumping conduit. Alternatively, low concentration slurries may not permit sufficient deposition of particulates within the well bore to form particulate plugs. Setting a particulate plug in a horizontal well bore, especially when utilizing low concentration slurries, often requires waiting for a certain degree of fracture closure to be able to bridge the particulate plug on the perforations. Indeed, attempts to form successful bridges have often failed, and those skilled in the art and practicing in the industry have typically engaged in practices which did not require the creation of bridges in horizontal well bores.

More recently, Halliburton Energy Services, Inc., of Duncan, Okla., has introduced and proven technologies for hydrajet treatment methods for both horizontal and vertical well bores. The methods may include the step of drilling a well bore into the subterranean formation of interest. Next, the well bore may or may not be cased and cemented, depending upon a number of factors, including the nature and structure of the subterranean formation. The casing and cement sheath, if installed, and well bore may then be perforated using a high-pressure fluid being ejected from a hydrajetting tool. A first zone of the subterranean formation may then be fractured and treated. Then, the first zone may temporarily be plugged or partially sealed by installing a viscous isolation fluid into the well bore adjacent to the one or more fractures and/or in the openings thereof, so that subsequent zones can be fractured and additional well operations can be performed. In one method, this process may generally be referred to by Halliburton as the CobraMax® H service, or stimulation method, and is described in U.S. Pat. No. 7,225,869, which is incorporated herein by reference. Such processes have been most successful in well bores that are deviated, horizontal, or inverted, where casing the hole is difficult and expensive. By using such techniques, it may be possible to generate one or more independent, single plane hydraulic fractures, and, therefore, a well bore that is deviated, horizontal, or inverted may be completed without the need to case the well bore.

Furthermore, even when highly deviated or horizontal well bores are cased, hydrajetting the perforations and fractures in such well bores may generally result in a more effective fracturing method than using traditional explosive charge perforation and fracturing techniques. However, the isolation fluid may be expensive, environmentally hazardous, and pose operational logistics challenges. For example, it may be difficult to remove these materials in preparation for production. Therefore, an alternate method of providing zone isolation in horizontal well bores is desirable to enhance these processes and provide greater reliability.

SUMMARY

The present invention relates to setting particulate plugs in horizontal well bores, and more particularly, in certain embodiments, to methods involving low-rate pumping of slurries.

One embodiment of the present invention provides a method for setting a particulate plug within an at least partially horizontal section of a well bore. The method comprises the step of selecting a deposition location for the particulate plug within the at least partially horizontal section of the well bore. The method further comprises the step of providing a pumping conduit capable of delivering slurries to the deposition location. The method further comprises the step of pumping a first slurry through the pumping conduit to the deposition location such that a velocity of the first slurry in the well bore at the deposition location is less than or equal to the critical velocity of the first slurry in the well bore at the deposition location.

In another embodiment, a method of treating a subterranean formation is provided. The method comprises the step of selecting a treatment zone in the subterranean formation. The method further comprises the step of providing a treatment fluid to the treatment zone through a well bore, wherein the well bore penetrates the treatment zone, and wherein at least a section of the well bore is at least partially horizontal proximate the treatment zone. The method further comprises the step of providing a pumping conduit capable of delivering slurries to a deposition location within the well bore proximate the treatment location. The method further comprises the step of pumping a first slurry through the pumping conduit to the deposition location such that a velocity of the first slurry in the well bore at the deposition location is less than or equal to the critical velocity of the first slurry in the well bore at the deposition location.

Yet another embodiment provides a method of setting a particulate plug within an at least partially horizontal section of a well bore. The method comprises the step of selecting a deposition location for the particulate plug within the at least partially horizontal section of the well bore. The method further comprises the step of providing one or more pumping conduits capable of delivering slurries to the deposition location. The method further comprises the step of pumping a first slurry through a first pumping conduit to the deposition location such that a velocity of the first slurry in the well bore at the deposition location is less than or equal to the critical velocity of the first slurry in the well bore at the deposition location. The method further comprises the step of successively pumping subsequent slurries through subsequent pumping conduits to the deposition location such that, for each subsequent slurry, a velocity of each subsequent slurry in the well bore at the deposition location is less than or equal to the critical velocity of such slurry in the well bore at the deposition location; wherein the pumping of subsequent slurries continues at least until a bridge forms proximate the deposition location.

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DESCRIPTION OF PREFERRED EMBODIMENTS

Figure 1A:
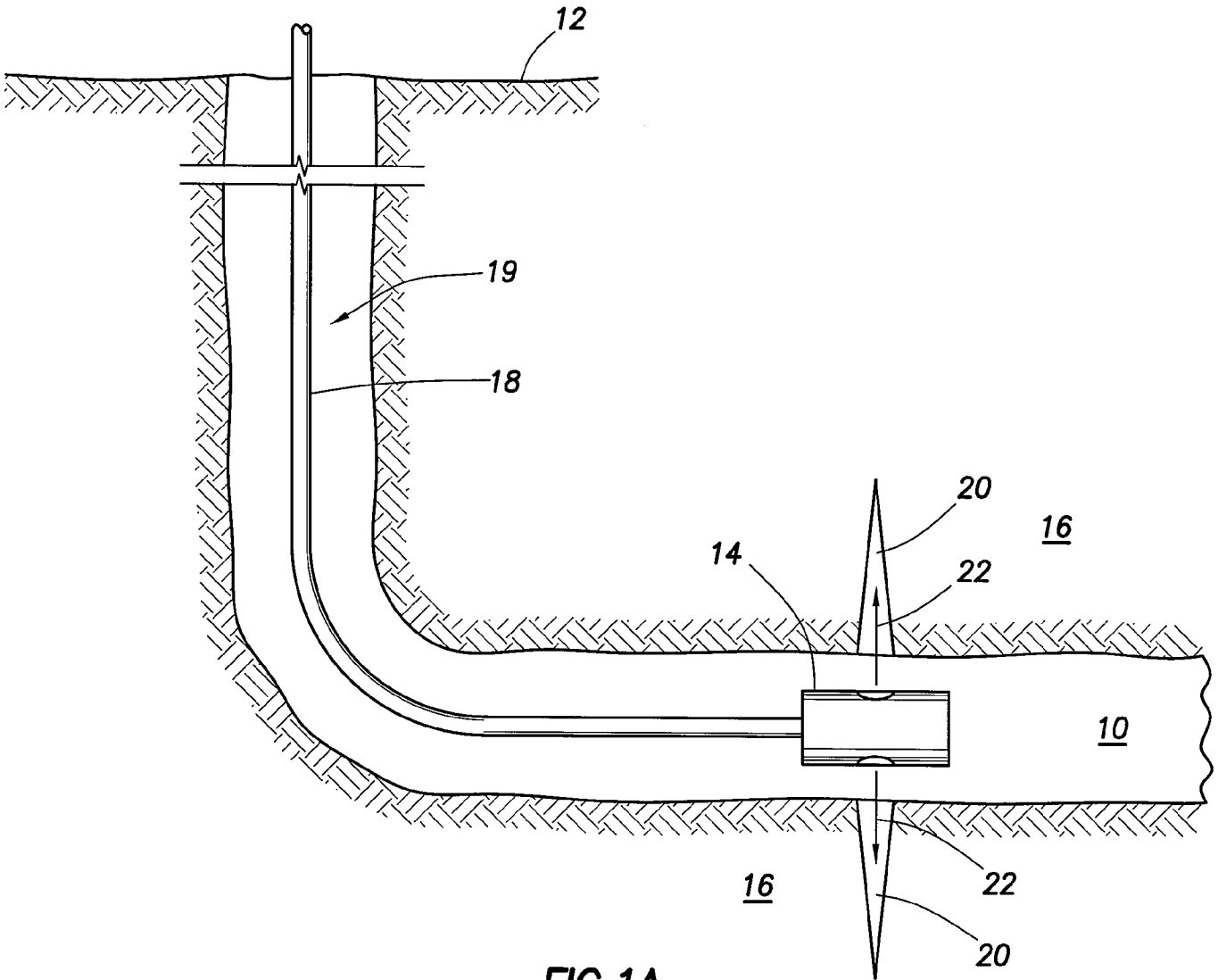
FIG. 1A illustrates a side view of a hydrajetting tool, according to one embodiment of the invention, creating perforation tunnels through an uncased horizontal well bore in a first zone of a subterranean formation.

The present invention relates to setting particulate plugs in horizontal well bores, and more particularly, in certain embodiments, to methods involving low-rate pumping of slurries.

As used herein, the term "treatment fluid" generally refers to any fluid that may be used in a subterranean application in conjunction with a desired function and/or for a desired purpose. The term "treatment fluid" does not imply any particular action by the fluid or any component thereof.

As used herein, the term "casing" generally refers to large-diameter pipe lowered into an open well bore. In some instances, casing may be cemented in place. Those of ordinary skill in the art with the benefit of this disclosure will appreciate that casing may be specially fabricated of stainless steel, aluminum, titanium, fiberglass, and other materials. As used herein, "casing" typically includes casing strings, slotted liners, perforated liners, and solid liners. Further, those of ordinary skill in the art with the benefit of this disclosure will appreciate the circumstances when a well bore should or should not be cased, whether such casing should or should not be cemented to the well bore, and whether the casing should be slotted, perforated, or solid.

As used herein, "pumping conduit" generally refers to any continuous, enclosed fluid path extending from the surface into a well bore, including, but not limited to, lengths of pipe, about 1 inch or larger casing, jointed pipe, spaghetti string, tubing, coiled tubing, or any annulus within a well bore, such as annuli created between the well bore and the casing, between the well bore and coiled tubing, between casing and coiled tubing, etc. The term "pumping conduit" does not imply that the substances contained therein experience any particular flow, force, or action.

As used herein, a "horizontal well bore" generally refers to a well bore with at least a portion having a centerline which departs from vertical by at least about 65°. In some instances, "horizontal well bore" may refer to a well bore which, after reaching true 90° horizontal, may actually proceed upward, or become "inverted." In such cases, the angle past 90° is continued, as in 95°, rather than reporting it as deviation from vertical, which would then be 85°. In any case, a "horizontal well bore" may simply be substantially horizontal, such that gravitational force would not cause a particulate to migrate along the length of the well bore.

The term "hydrajetting," and derivatives thereof, are defined herein to include the use of any method or tool wherein a treatment fluid is propelled at a surface inside a subterranean formation so as to erode at least a portion of that surface.

As used herein, the term "zone" generally refers to a portion of the formation and does not imply a particular geological strata or composition As used herein, the term "bridge" generally refers to the accumulation or buildup of particulates or material, such as sand, proppant, gravel, or filler, within a conduit, to the extent that the flow of slurries in the conduit is restricted. Generally, continued pumping of a slurry at a bridge would form an immovable pack of solids.

As used herein, the term "particulate plug(s)" generally refers to an accumulation or buildup of particulates or material within a conduit to the extent that the flow of fluids in the conduit is restricted and the flow of slurries in the conduit is obstructed. Typically, "particulate plug(s)" may be more substantial than bridges, and may thereby be more capable than bridges to withstand higher fluid pressures.

As used herein, the term "proximate" refers to relatively close proximity, for example, within a distance of about 500 ft.

If there is any conflict in the usages of a word or term in this specification and one or more patent or other documents that may be incorporated herein by reference, the definitions that are consistent with this specification should be adopted for the purposes of understanding this invention.

The methods of various embodiments of the present invention may particularly be adapted for use in the treatment of a subterranean formation under a variety of geological conditions, particularly when access to the subterranean formation is provided through a horizontal well bore. In some embodiments, the methods may be adapted for use in treatments such as those used during Halliburton's CobraMax® H service. In other embodiments, the methods may be adapted for use in treatments which utilize a pumping conduit and which may require particulate plugs to provide isolation of zones of interest. It is contemplated that the methods may be used over a substantial range of well depths and lengths, wherein a substantial number of different production zones may be treated. The methods of certain embodiments of the present invention may be applied to well bores with lengths ranging from several tens to several thousand feet. Of the many advantages to these methods, only some of which are herein disclosed, efficient installation of one or more particulate plugs in horizontal well bores may result in better utilization of treatment fluids. Another potential advantage of the methods of some embodiments of the present invention may be a lower fluid load on the formation, and may thereby result in reduced operation costs.

Figure 1B:
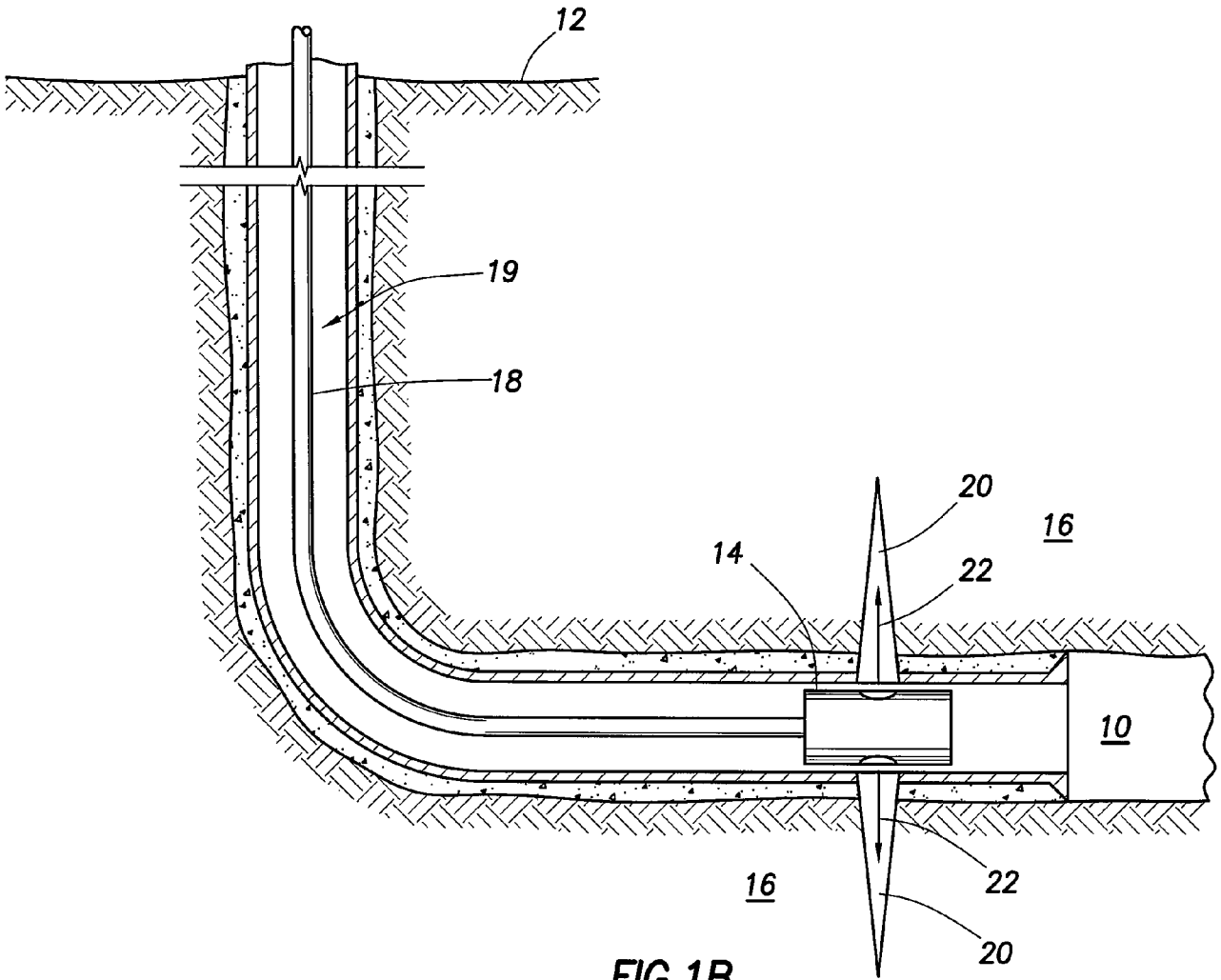
FIG. 1B illustrates a side view of a hydrajetting tool, according to one embodiment of the invention, creating perforation tunnels through a cased horizontal well bore in a first zone of a subterranean formation.

The details of several embodiments of the methods of the present invention will now be described with reference to the accompanying drawings. In FIG. 1, a well bore 10 may be drilled into a subterranean formation 12 using conventional (or future) drilling techniques. Next, depending upon the nature of the formation 12, the well bore 10 may either be left open hole, or uncased, as shown in FIG. 1A, or the well bore 10 may be lined with a casing, as shown in FIG. 1B. As would be understood by one of ordinary skill in the art with the benefit of this disclosure, the well bore 10 may be cased or uncased in several instances. For example, if the subterranean formation 12 is highly consolidated, or if the well is a highly deviated or horizontal, it is typically difficult to case the well bore. In instances where the well bore 10 is lined with a casing, the casing may or may not be cemented to the formation 12. As an example, the casing in FIG. 1B is shown cemented to the subterranean formation 12. Furthermore, while FIGS. 2-5 illustrate an uncased well bore, those of ordinary skill in the art with the benefit of this disclosure will recognize that each of the illustrated and described steps may be carried out in a cased well bore. In some embodiments, the method of the present invention may also be applied to a previously established well bore with one or more zones in need of treatment.

Figure 2:
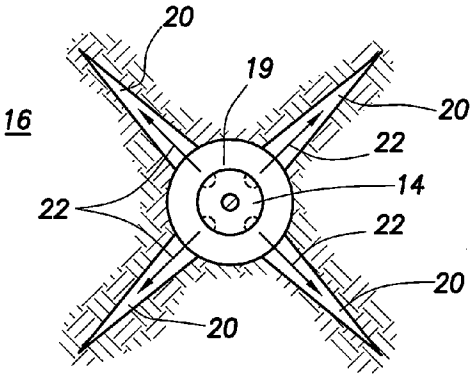
FIG. 2 illustrates a cross-sectional view of a hydrajetting tool, according to one embodiment of the invention, forming four perforation tunnels in a first zone of a subterranean formation.

Once the well bore 10 is drilled and, if deemed necessary, cased, a hydrajetting tool 14 may be placed into the well bore 10 at a location of interest. In some embodiments, the hydrajetting tool 14 may be such as that used in Halliburton's CobraMax® H service. The location of interest may be adjacent to a first zone 16 in the subterranean formation 12. In one exemplary embodiment, the hydrajetting tool 14 may be attached to a pumping conduit 18, which may lower the hydrajetting tool 14 into the well bore 10 and may supply it with fluid 22. Annulus 19 may be formed between the pumping conduit 18 and the well bore 10 (or casing, as in FIG. 1B). The hydrajetting tool 14 may then operate to form perforation tunnels 20 in the first zone 16, as shown in FIG. 1. The fluid 22 being pumped through the hydrajetting tool 14 may contain a carrier fluid, such as water, and abrasives (commonly sand). As shown in FIG. 2, four equally spaced jets (in this example) of fluid 22 may be injected into the first zone 16 of the subterranean formation 12. As those of ordinary skill in the art with the benefit of this disclosure will recognize, the hydrajetting tool 14 may have any number of jets, which may be configured in a variety of combinations along and around the hydrajetting tool 14.

Figure 3:
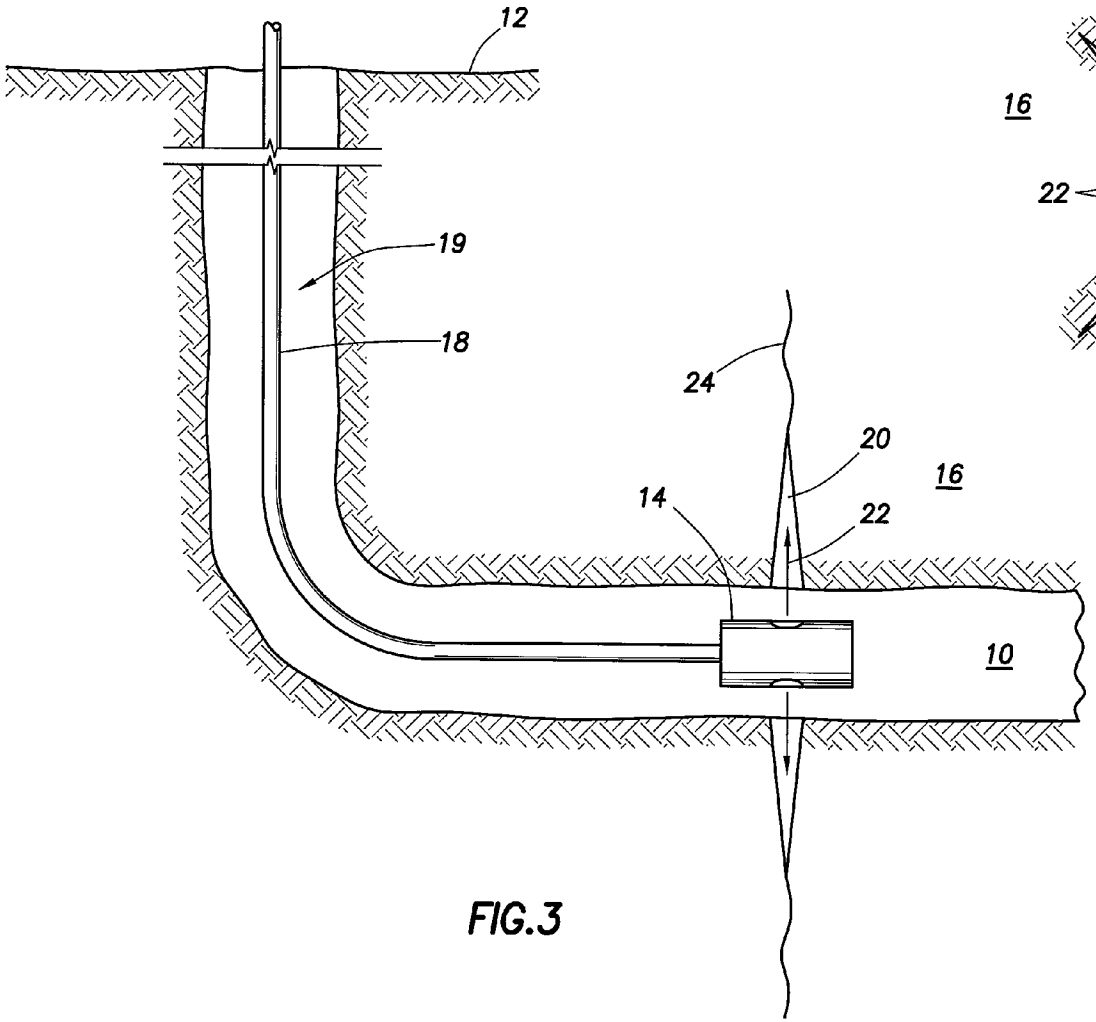
FIG. 3 illustrates a side view of a hydrajetting tool, according to one embodiment of the invention, creating fractures in a first zone of a subterranean formation.

In the next step, according to one embodiment of the present invention, the first zone 16 may be fractured. This may be accomplished by any one of a number of ways. In one exemplary embodiment, the hydrajetting tool 14 may inject a highly pressurized fracture fluid into the perforation tunnels 20. As those of ordinary skill in the art with the benefit of this disclosure will appreciate, the pressure of the fracture fluid exiting the hydrajetting tool 14 may be sufficient to fracture the formation in the first zone 16. Using this technique, the fracture fluid may form cracks or fractures 24 along the perforation tunnels 20, as shown in FIG. 3. In a subsequent step, an acidizing fluid may be injected into the formation through the hydrajetting tool 14. The acidizing fluid may etch the formation along the cracks 24, thereby widening them.

In another exemplary embodiment, the fluid 22 may carry a proppant into the cracks or fractures 24. The injection of additional fluid may extend the fractures 24, and the proppant may prevent the fractures from closing up at a later time. Some embodiments of the present invention contemplate that other fracturing methods may be employed. For example, the perforation tunnels 20 may be fractured by pumping a hydraulic fracture fluid into them from the surface through annulus 19. Next, optionally, either an acidizing fluid or a proppant fluid may be injected into the perforation tunnels 20 so as to further extend and widen them. Other fracturing techniques may be used to fracture the first zone 16.

The proppant that may be used in various embodiments of the present invention may include any sand, proppant, gravel, filler particulates, combinations thereof, or any other such material that may be used in a subterranean application. One of ordinary skill in the art with the benefit of this disclosure will be able to select appropriate proppant based on such factors as costs, supply logistics, and operations engineering requirements.

Once the first zone 16 has been treated, several embodiments of the present invention provide for isolating the first zone 16. In these embodiments, subsequent well operations, such as the treatment of additional zones, may be carried out without the loss of significant amounts of fluid into the first zone 16. Isolation may be carried out in a number of ways. In several embodiments, isolation may be carried out by setting a particulate plug 28 in a deposition location in well bore 10 which is proximate zone 16.

Figure 4A:
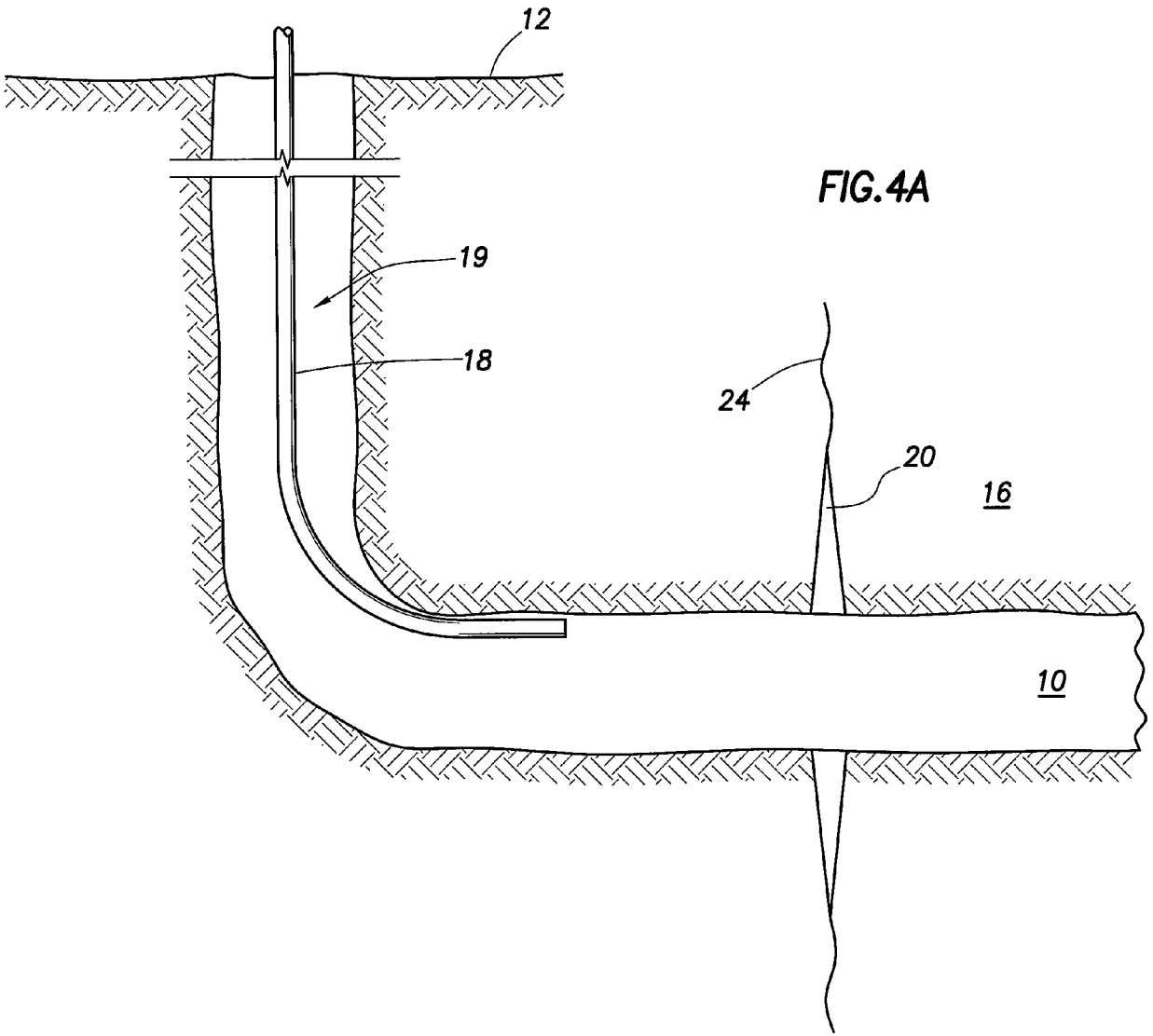
FIG. 4A illustrates a side view of a well bore in a first zone of a subterranean formation subsequent to a fracturing operation, according to one embodiment of the invention.
Figure 4B:
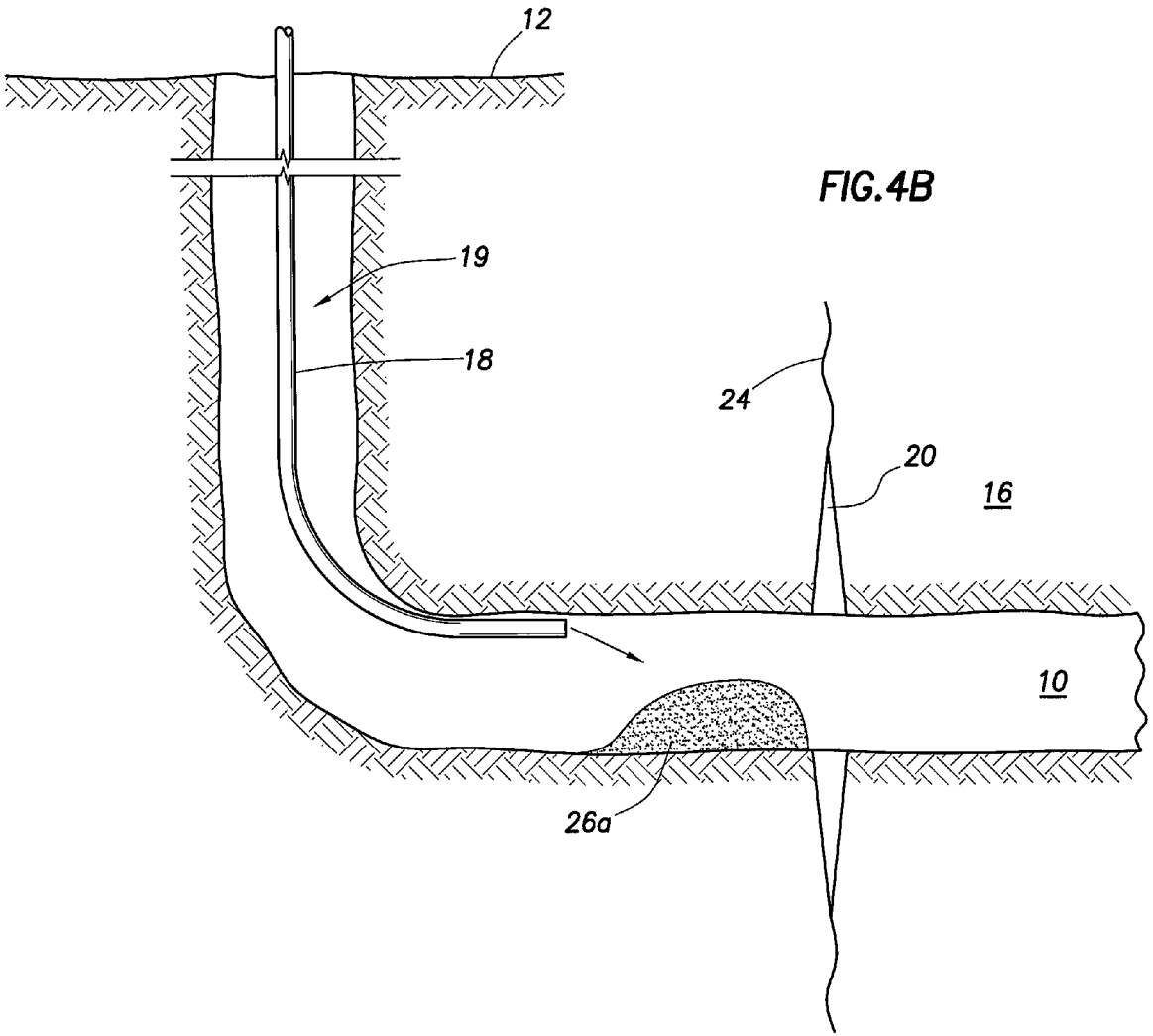
FIG. 4B illustrates a side view of a pumping conduit, according to one embodiment of the invention, delivering a particulate slurry to a well bore location nearby a first zone of a subterranean formation.
Figure 4C:
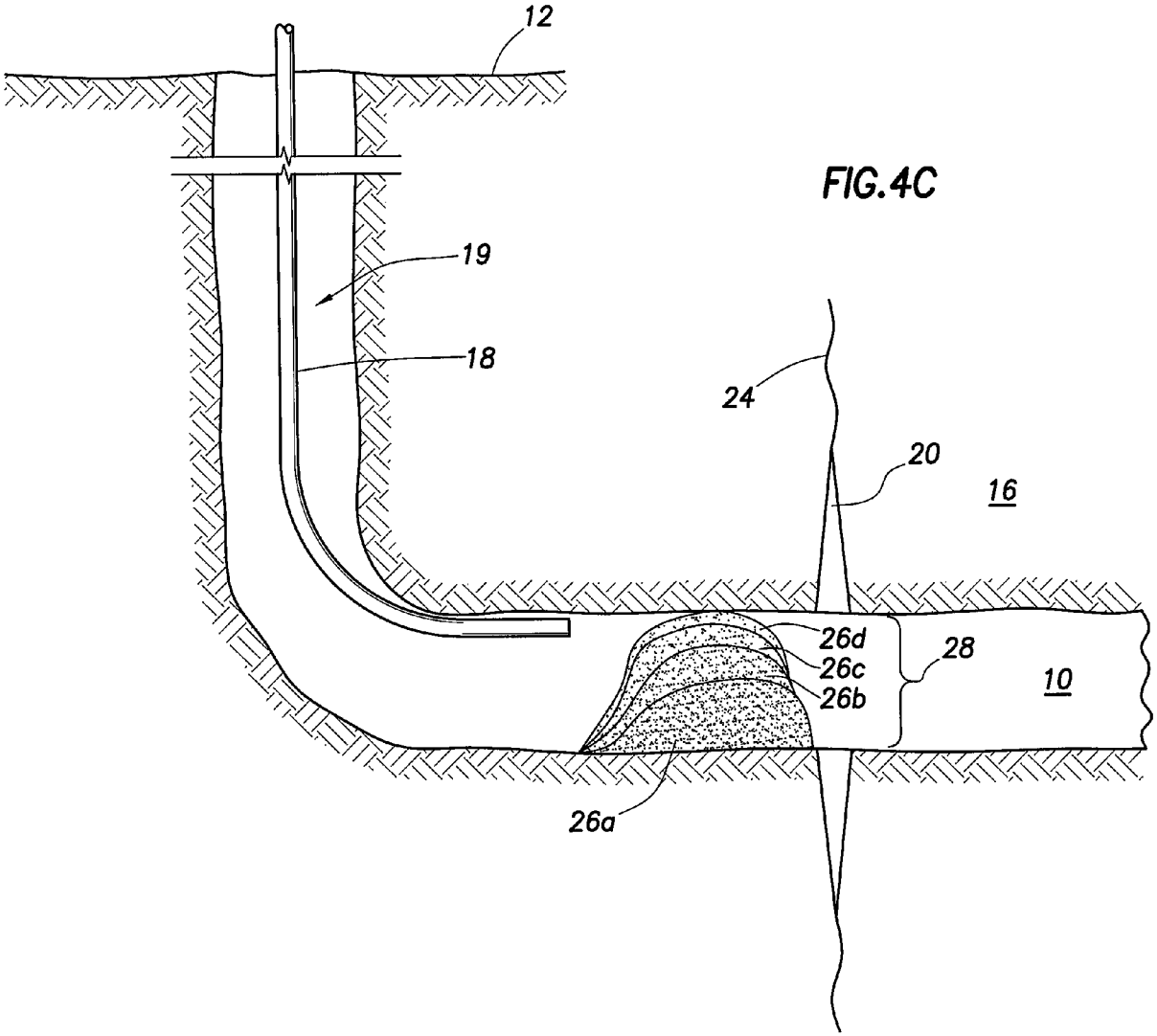
FIG. 4C illustrates a side view of a well bore in a first zone of a subterranean formation subsequent to deposition of particulate slurries, according to one embodiment of the invention.

In some embodiments, hydrajetting tool 14 may be removed, as illustrated in FIG. 4A, and a particulate slurry may be prepared and delivered through the pumping conduit 18 into the well bore 10 to form particulate bed 26*a* at a deposition location proximate zone 16, as illustrated in FIG. 4B. Alternatively, hydrajetting tool 14 may be otherwise bypassed, or hydrajetting tool 14 may be pumped through at a low rate, inter alia, to minimize erosion of particulate depositions, such as particulate bed 26*a*. In some embodiments, a second particulate slurry may be prepared and delivered through the pumping conduit 18 into well bore 10 to form particulate bed 26*b* on top of particulate bed 26*a*, as illustrated in FIG. 4B. The second particulate slurry may or may not substantially differ from the first particulate slurry in composition. For example, the subsequent particulate slurry may have higher or lower particulate concentration, larger or smaller size particulates, and/or a more or less viscous base fluid. As will be discussed in greater detail, the rate of pumping of the second particulate slurry may be such that particulate bed 26*a* does not substantially erode. In some embodiments, this process may be repeated as many times as necessary to form successive layers of particulate beds, for example, particulate beds 26*a*-26*d*, until the particulate beds bridge at the top of well bore 10 proximate zone 16. Although shown bridging in open well bore 10, the particulate beds also may bridge in a casing or in perforation tunnels which are proximate zone 16, depending on the particular configuration of the well bore. Without limiting the invention to a particular theory or mechanism of action, it is nevertheless currently believed that bridging may occur as irregular ripples in the surface of the deposition bed, the concentration of the particulate slurry above the deposition bed, or both, reach the height of the conduit, thereby providing for a buildup of particulate behind the ripples. As would be understood by a person of ordinary skill in the art with the benefit of this disclosure, bridging may be inferred from a substantial increase in fluid pressure. For example, during low rating pumping, over a period of about five minutes, the fluid pressure at the surface may rise from about 5000 psi to about 10,000 psi.

Figure 5A:
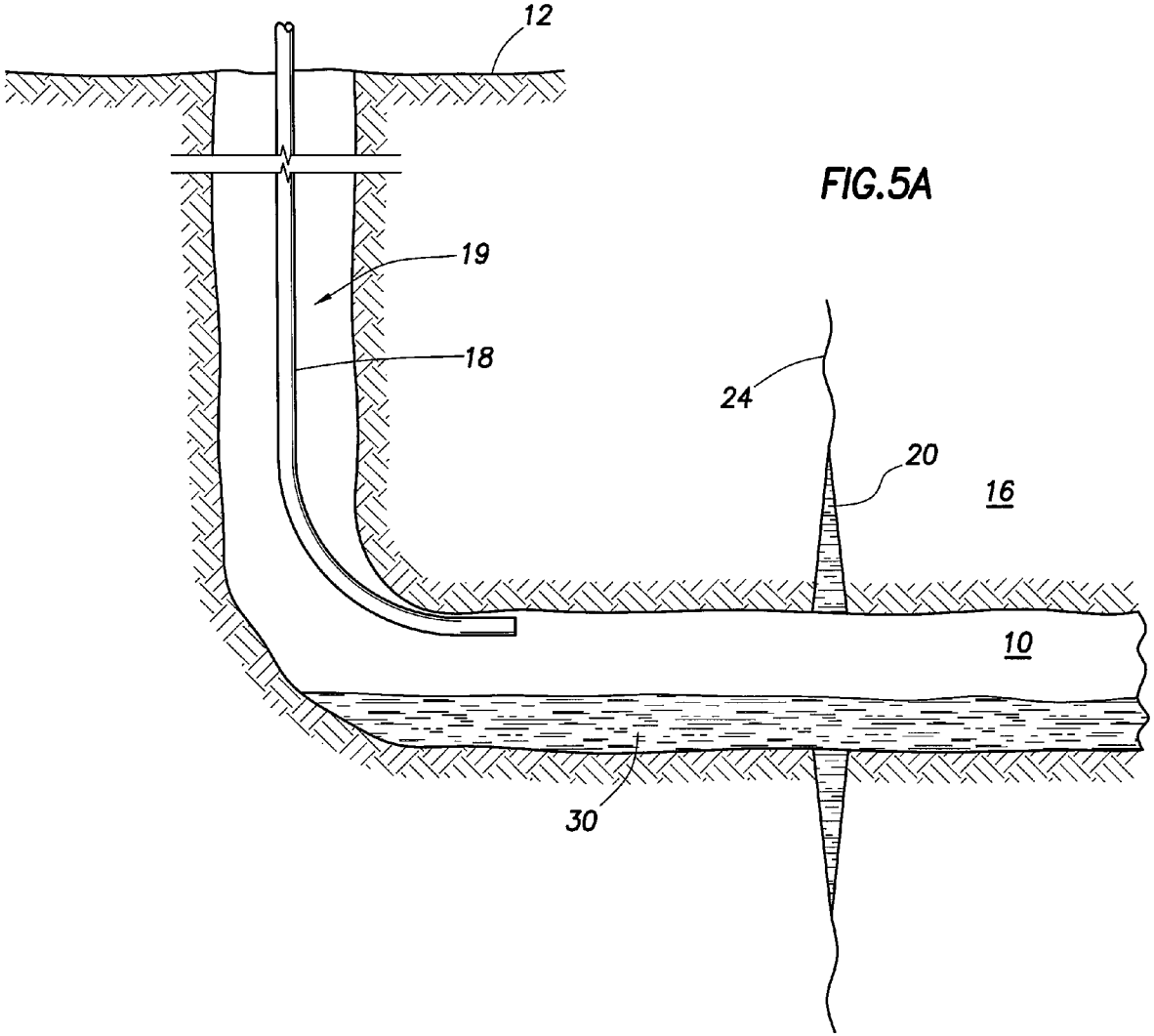
FIG. 5A illustrates a side view of a well bore in a first zone of a subterranean formation subsequent to a fracturing operation utilizing proppant, according to one embodiment of the invention.
Figure 5B:
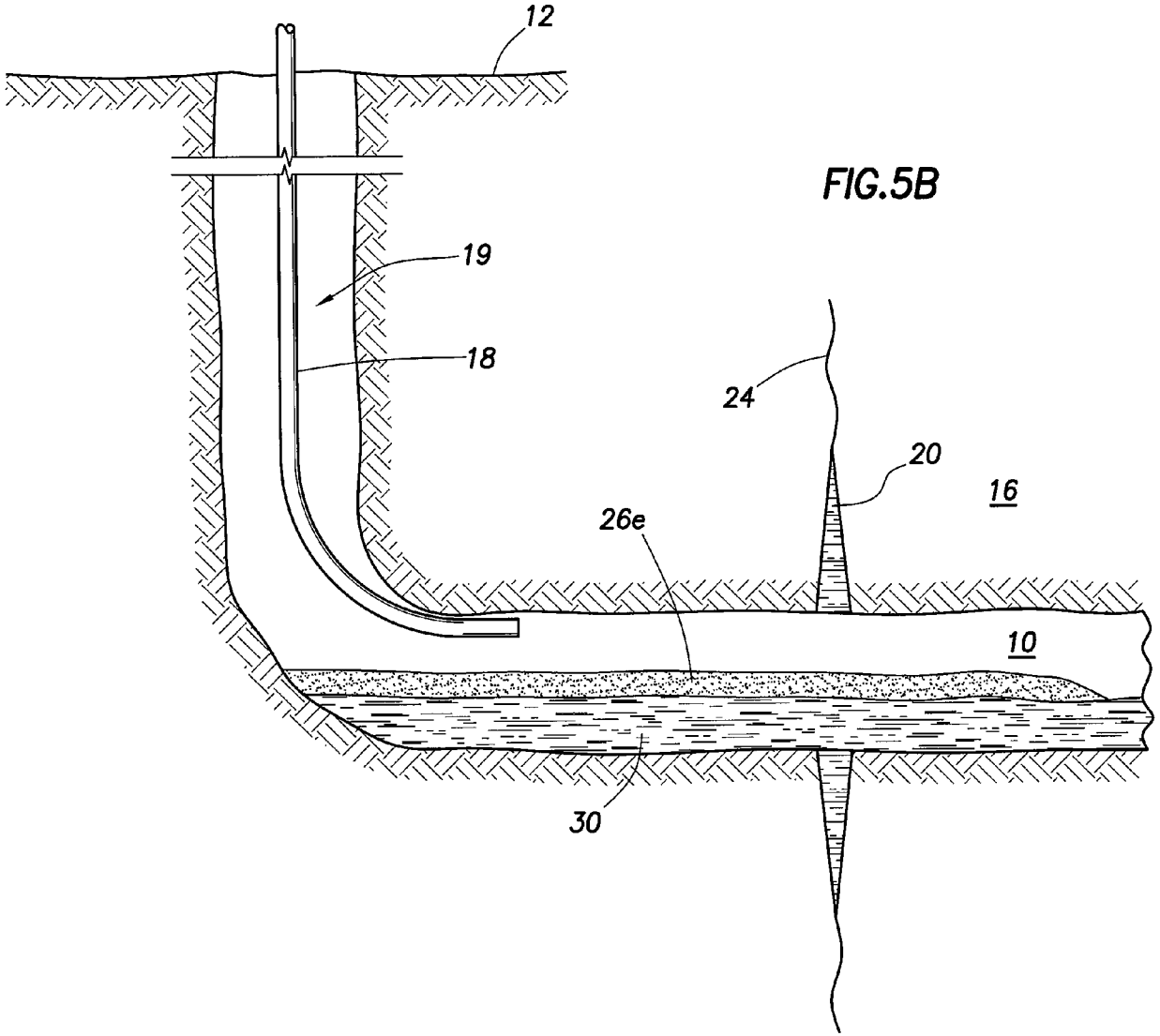
FIG. 5B illustrates a side view of a pumping conduit, according to one embodiment of the invention, delivering a particulate slurry to a well bore location which is nearby a first zone of a subterranean formation, and which contains proppant.
Figure 5C:
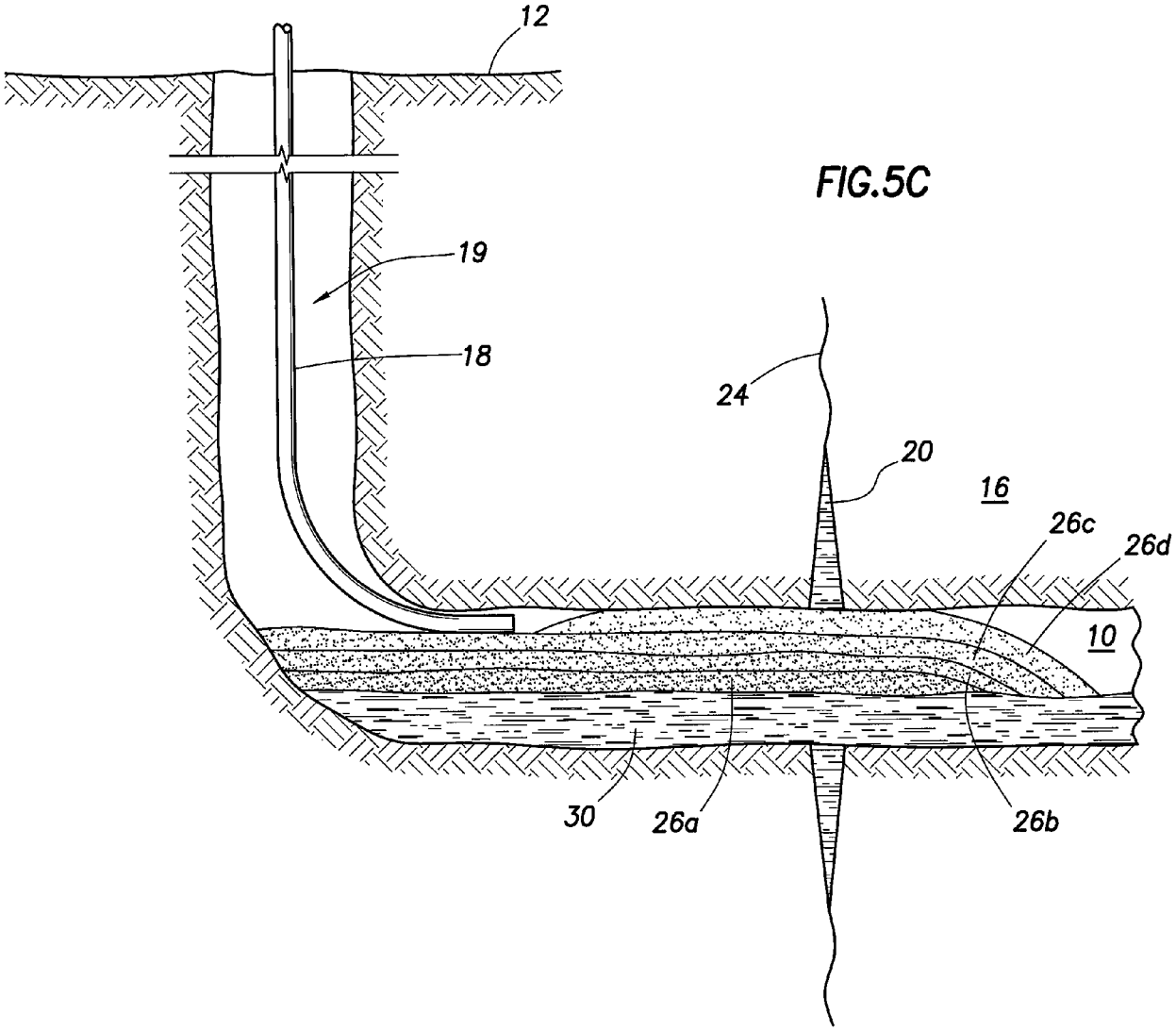
FIG. 5C illustrates a side view of a well bore in a first zone of a subterranean formation subsequent to a fracturing operation utilizing proppant, and subsequent to deposition of particulate slurries, according to one embodiment of the invention.

In other embodiments of the invention, typically following treatments involving proppant, first zone 16 may be isolated by a proppant-particulate plug 28. Suitable proppant for these embodiments may not substantially differ from that previously discussed. The preceding treatment may conclude in a fashion which leaves unconsolidated proppant 30 in well bore 10 in a deposition location proximate zone 16, as illustrated in FIG. 5A. The preceding treatment may convey proppant through annulus 19, or the preceding treatment may convey proppant through pumping conduit 18. In some embodiments, the preceding treatment may utilize proppant which is in high concentration in a carrier fluid. For example, in some embodiments, the concentration may range from about 5 pounds of proppant per gallon of carrier fluid (lbs/gal) to about 30 lbs/gal. In some embodiments, the concentration may range from about 10 lbs/gal to about 25 lbs/gal. In some embodiments, the concentration may range from about 15 lbs/gal to about 20 lbs/gal. At the conclusion of the preceding treatment in some embodiments of the present invention, the pumping rate of proppant-carrying fluid 22 may be reduced below the preferred pumping rate for the previous treatment. Additionally, in some embodiments, the proppant pumped during, and/or at the conclusion of, the preceding treatment may be allowed to settle in well bore 10. One of ordinary skill in the art with the benefit of this disclosure will be able to determine the appropriate pumping rates and settling times according to factors such as well bore geometry, proppant type, treatment fluid compositions, costs, and supply logistics. A particulate slurry may be prepared and delivered through the pumping conduit 18 into the well bore 10 following the preceding treatment involving proppant to form particulate bed 26*e*, as illustrated in FIG. 5B. As will be discussed in greater detail, the rate of pumping of the particulate slurry may be such that unconsolidated proppant 30 does not substantially erode or become re-suspended. In some embodiments, a second particulate slurry may be prepared and delivered through the pumping conduit 18 into well bore 10 to form particulate bed 26*f* on top of particulate bed 26*e*, as illustrated in FIG. 5C. The second particulate slurry may or may not substantially differ from the first particulate slurry in composition. For example, the subsequent particulate slurry may have higher or lower particulate concentration, larger or smaller size particulates, and/or a more or less viscous base fluid. As will be discussed in greater detail, the rate of pumping of the second particulate slurry may be such that particulate bed 26*e* does not substantially erode. In some embodiments, this process may be repeated as many times as necessary to form successive layers of particulate beds, for example, particulate beds 26*e*-26*h*, until the particulate beds bridge at the top of well bore 10 proximate zone 16. Although shown bridging in open well bore 10, the particulate beds also may bridge in a casing or in perforation tunnels which are proximate zone 16, depending on the particular configuration of the well bore. Without limiting the invention to a particular theory or mechanism of action, it is nevertheless currently believed that bridging may occur as irregular ripples in the surface of the deposition bed, the concentration of the particulate slurry above the deposition bed, or both, reach the height of the conduit, thereby providing for a buildup of particulate behind the ripples. As would be understood by a person of ordinary skill in the art with the benefit of this disclosure, bridging may be inferred from a substantial increase in fluid pressure. For example, during low rating pumping, over a period of about five minutes, the fluid pressure at the surface may rise from about 5000 psi to about 10,000 psi.

In certain embodiments, once a particulate plug 28 has been set in well bore 10, a plug sealing fluid may be applied to the particulate plug 28. The plug sealing fluid may reduce the permeability of the particulate plug. Suitable plug sealing fluids according to some embodiments may be any fluids capable of reducing the permeability of the particulate plug without adversely reacting with the other components of the subterranean application. In some embodiments, the plug sealing fluid may be a drill-in fluid. For example, the plug sealing fluid may be a drill-in fluid as discussed in U.S. Patent Application Publication No. 2008/0070808 to Munoz, et al., which is hereby incorporated by reference. Other examples of suitable plug sealing fluids according to the methods of some embodiments may include a guar solution (e.g., 250 mL of WG-11™ Gelling Agent, commercially available from Halliburton Energy Services of Duncan, Okla., in 2% potassium chloride solution), a polylactic acid (e.g., 3 g of BioVert™ H150, commercially available from Halliburton Energy Services of Duncan, Okla., at 0.100 lbs/gal), or a starch solution (e.g., 5 g of N-DRIL™ HT PLUS, commercially available from Halliburton Energy Services of Duncan, Okla., at 0.167 lbs/gal). In some embodiments, a suitable plug sealing fluid would degrade with time (i.e., "self-degrading"), exposure to hydrocarbons, and/or exposure to "breaker" fluids.

In some embodiments of the invention, particulate plugs may be created by methods which result in increased deposition of particulate in the (cased or uncased) well bore along with decreased deposition of particulate in the pumping conduit. Such methods may seek to identify a pumping rate which provides (1) a slurry velocity inside the pumping conduit sufficiently high to limit, minimize, or eliminate deposition within the pumping conduit, (2) a slurry velocity inside the well bore which is sufficiently low to provide adequate deposition of particulate within the well bore, and (3) a deposition rate within the well bore which meets or exceeds the rate of erosion of previous particulate depositions within the well bore.

As would be understood by one of ordinary skill in the art with the benefit of this disclosure, in the transport of particulate slurries through conduits, there exists a "critical velocity" at and below which full suspension of the particulate gives way to settle-out, followed by the build-up of particulate deposits, or "beds," within the conduit. Generally, fluids with higher viscosities and non-Newtonian fluids tend to have lower critical velocities. Generally, larger conduits will produce higher critical velocities. Without limiting the invention to a particular theory or mechanism of action, it is nevertheless currently believed that slurries in narrower conduits may experience greater turbulence, which may produce additional eddies which may be effective in maintaining particles in suspension. Generally, denser particulates will result in higher critical velocities. For low viscosity fluids, critical velocity generally increases with particulate concentration, but critical velocity is generally independent of concentration in higher viscosity fluids. The critical velocity of Newtonian carrier fluids may be determined from the correlation of the energy balance required to suspend particulates with the energy dissipated by an appropriate fraction of turbulent eddies present in the flow:

$$\frac{v_{Dc}}{\sqrt{gd_p(F_s-1)}} = 1.85C^{0.1536}(1-C)^{0.3564}\times(d_p/d)^{-0.378}N_{Re}'^{0.09}F^{0.30} \quad \text{Eq. 1}$$

wherein, C is the particulate concentration in volume fraction, d is the conduit diameter, $d_p$ is the particle diameter, F is the fraction of eddies with velocities exceeding hindered settling velocity, $F_s$ is the ratio of particulate to fluid densities, g is the acceleration of gravity, $N'_{Re}$ is the modified Reynolds number, and $v_{Dc}$ is the critical velocity. To account for non-Newtonian carrier fluids, Eq. 1 may be generalized as:

$$\frac{v_{Dc}}{\sqrt{gd_p(F_s-1)}} = YC^{0.1536}(1-C)^{0.3564}\times(d_p/d)^{-w}N_{Re}'^{S}F^{0.30} \quad \text{Eq. 2}$$

wherein Y, w, and z are adjustable constants that can be evaluated by regression analysis for particular critical velocity data sets. To summarize, factors that determine critical velocity may include effective diameter of the conduit, physical and rheological properties of the carrier fluid, size, density, and concentration of the particles, and specific gravity of the slurry.

Therefore, according to some embodiments of the present invention, an increased deposition of particulate in the (cased or uncased) well bore and decreased deposition of particulate in the pumping conduit may be achieved at a pumping rate which provides (1) a slurry velocity in the pumping conduit that exceeds the critical velocity of the slurry in the pumping conduit, and (2) a slurry velocity in the well bore that is less than or equal to the critical velocity of the slurry in the well bore. Moreover, previous particulate deposition in the well bore may decrease the effective diameter of the well bore. For a given critical velocity, the minimum effective diameter may be determined from the above equations. When the minimum effective diameter exceeds the actual effective diameter, the rate of erosion may exceed the rate of deposition. Therefore, according to some embodiments of methods of the present invention, deposition of particulate in the well bore may be enhanced at a pumping rate which provides (3) a critical velocity in the well bore with a minimum effective diameter that is less than the actual effective diameter of the well bore with any previous particulate depositions. In other words, deposition in the well bore may be increased when the slurry velocity in the well bore is less than or equal to the critical velocity of the slurry in the well bore with any previous deposition. It may not always be feasible to pump at a pumping rate satisfying all three parameters. In some embodiments, the slurry velocity in the pumping conduit may be less than or equal to the critical velocity of the slurry in the pumping conduit such that deposition within pumping conduit may be less than or equal to about 20% of the internal diameter of the pumping conduit. In some embodiments, the slurry velocity in the pumping conduit may be less than or equal to the critical velocity of the slurry in the pumping conduit such that deposition within pumping conduit may be less than or equal to about 10% of the internal diameter of the pumping conduit. In some embodiments, the pumping rate may range from about 0.1 to about 2 barrel per minute.

Particulate plugs may be desired in specifically identified deposition locations within the well bore 10. Moreover, in embodiments wherein the well bore is cased, particulate plugs may be desired at deposition locations either within the casing or in the annulus between the casing and the well bore. Particulate plugs may also be desired to have specified dimensions. As previously discussed, for a given critical velocity, the minimum effective diameter of a conduit with a particulate bed may be determined. Basic geometry may be used to calculate effective height of the particulate bed from the minimum effective diameter. The length of a particulate bed may likewise be calculated: as the slurry travels downhole and particulates settle-out, the concentration of particulates in the slurry may fall below the minimum effective concentration for a given critical velocity and minimum effective diameter. At and beyond the point in the well bore when that happens, the height of the particulate bed may fall below the height determined to correlate to the minimum effective diameter. One of ordinary skill in the art with the benefit of this disclosure would be able to identify well bore parameters which determine most desirable particulate plug characteristics, including location and dimensions. For example, in some embodiments, the desired length of the particulate plug may vary as the distance between treatment zones vary. In some embodiments, the desired length of a particulate plug may range from about 50 ft to about 500 ft. In some embodiments, the desired length of a particulate plug may range from about 100 ft to about 200 ft.

The particulate slurry may generally include particulates and a base fluid. In some embodiments, the particulate slurry may include additional materials, such as surfactants, viscosifiers, adhesives, resins, tackifiers, iron control additives, breakers, or other materials commonly used in the treatment of subterranean formations. Some embodiments may specifically exclude certain additional materials which may indefinitely suspend particulates, e.g., crosslinkers. The specific gravity and concentration of the particulate slurry may vary according to the type of particulate and base fluid selected. In some embodiments, the specific gravity of the particulate slurry may range from about 1.0 to about 2.5. In some embodiments, the specific gravity of the particulate slurry may range from about 1.4 to about 2.0. Generally, the concentration of the particulate in the particulate slurry may be any amount which provides a slurry which is pumpable through the pumping conduit. In certain embodiments of the invention, the concentration of particulate in the particulate slurry may range from about 1 to about 25 lbs/gal. In other embodiments, the concentration may range from about 2 to about 10 lbs/gal. In other embodiments, the concentration may range from about 4 to about 8 lbs/gal. In some embodiments, the base fluid may be a low viscosity fluid. In some embodiments, the particulate slurry may be a low viscosity fluid. For example, suitable low viscosities may be between about 0.1 cP to about 50 cP, as measured using a fann® Model 35 Viscometer.

The particulate that may be used in embodiments of the present invention may generally include any sand, proppant, gravel, filler particulates, or any other such material that may be used in a subterranean application. One of ordinary skill in the art with the benefit of this disclosure will be able to select appropriate particulate based on such factors as costs, supply logistics, and operations engineering requirements. In some embodiments, denser particulates may provide more desirable performance. Suitable particulate may include common sand, resin-coated particulates, sintered bauxite, silica alumina, glass beads, fibers, etc. Other suitable particulate may include, but are not limited to, bauxite, fumed silica, ceramic materials, resin-coated ceramic materials, chemically bonded ceramics, glass materials, polymer materials, Teflon® materials, polytetrafluoroethylene materials, polylactic acid materials, elastomers, natural rubbers, waxes, resins, FlexSand™ (commercially available from BJ Services Company of Houston, Tex.), nut shell pieces, seed shell pieces, fruit pit pieces, wood, composite particulates, paraffin, encapsulated acid or other chemical, resin beads, degradable proppant, coated proppant, and combinations thereof. Suitable composite materials may comprise a binder and a particulate material wherein suitable particulate materials include silica, alumina, fumed carbon, carbon black, graphite, mica, titanium dioxide, meta-silicate, calcium silicate, kaolin, talc, zirconia, boron, fly ash, hollow glass microspheres, solid glass, and combinations thereof. Suitable particulates may take any shape including, but not limited to, the physical shape of platelets, shavings, flakes, ribbons, rods, strips, spheres, spheroids, ellipsoids, toroids, pellets, or tablets. Although a variety of particulate sizes may be useful in the present invention, in certain embodiments, particulate sizes may range from about 200 mesh to about 8 mesh.

The base fluids that may be used in accordance with some embodiments of the present invention may include any suitable fluids that may be used to transport particulates in subterranean operations. Suitable fluids may include ungelled aqueous fluids, aqueous gels, hydrocarbon-based gels, foams, emulsions, viscoelastic surfactant gels, and any other suitable fluid. Suitable emulsions may be comprised of two immiscible liquids such as an aqueous liquid or gelled liquid and a hydrocarbon. Foams may be created by the addition of a gas, such as carbon dioxide or nitrogen. Suitable aqueous gels may be generally comprised of water and one or more gelling agents. In exemplary embodiments, the base fluid may be an aqueous gel comprised of water, a gelling agent for gelling the aqueous component and increasing its viscosity, and, optionally, a crosslinking agent for crosslinking the gel and further increasing the viscosity of the fluid. The increased viscosity of the gelled, or gelled and crosslinked, aqueous gels, inter alia, may reduce fluid loss and enhances the suspension properties thereof. An example of a suitable crosslinked aqueous gel may be a borate fluid system utilized in the Delta Frac® Service, commercially available from Halliburton Energy Services, Duncan Okla. Another example of a suitable crosslinked aqueous gel may be a borate fluid system utilized in the SeaQuest® Service, commercially available from Halliburton Energy Services, Duncan, Okla. The water used to form the aqueous gel may be fresh water, saltwater, brine, or any other aqueous liquid that does not adversely react with the other components. The density of the water may be increased to provide additional particle transport and suspension in some embodiments of the present invention.

One of ordinary skill in the art with the benefit of this disclosure would appreciate which particulates and which base fluid may be most effective in a given well bore geometry and for the desired location and dimensions of the particulate plug. In certain embodiments of the present invention, the particulate slurries may be adjusted to provide conditions necessary for forming a particulate plug with desired particulate plug characteristics, including location and dimensions. In certain embodiments, adjustments in the type of particulate and the specific gravity and concentration of the particulate slurries may be continuously modified to be effective given the constraints of the operation.

In some embodiments, the aforementioned steps may be repeated for subsequent zones of interest within the formation.

Once each of the desired zones of interest has been treated, the particulate plugs 28 may be breached, thereby unplugging the fractures 24 for subsequent use in the recovery of fluids from the subterranean formation 12. One method to breach the particulate plugs 28 may be to allow the production of fluid from the fractures 24 to degrade the particulate plugs 28. In some embodiments, the particulate and/or the proppant may consist of chemicals that break or reduce the integrity of the particulate plug 28 over time to allow easy breach of the particulate plugs 28. Another method to breach the particulate plugs 28 may be to circulate a fluid, gas, or foam into the well bore 10, thereby degrading the particulate plugs 28. Another method of breaching the particulate plugs 28 may be to use hydrajetting tool 14 to degrade the particulate plugs 28. In alternative embodiments, the method of breaching the particulate plugs 28 may be any method of breaching known to persons of ordinary skill in the art.

To facilitate a better understanding of the present invention, the following examples of certain aspects of some embodiments are given. In no way should the following examples be read to limit, or define, the entire scope of the invention.

EXAMPLE

Figure 6:
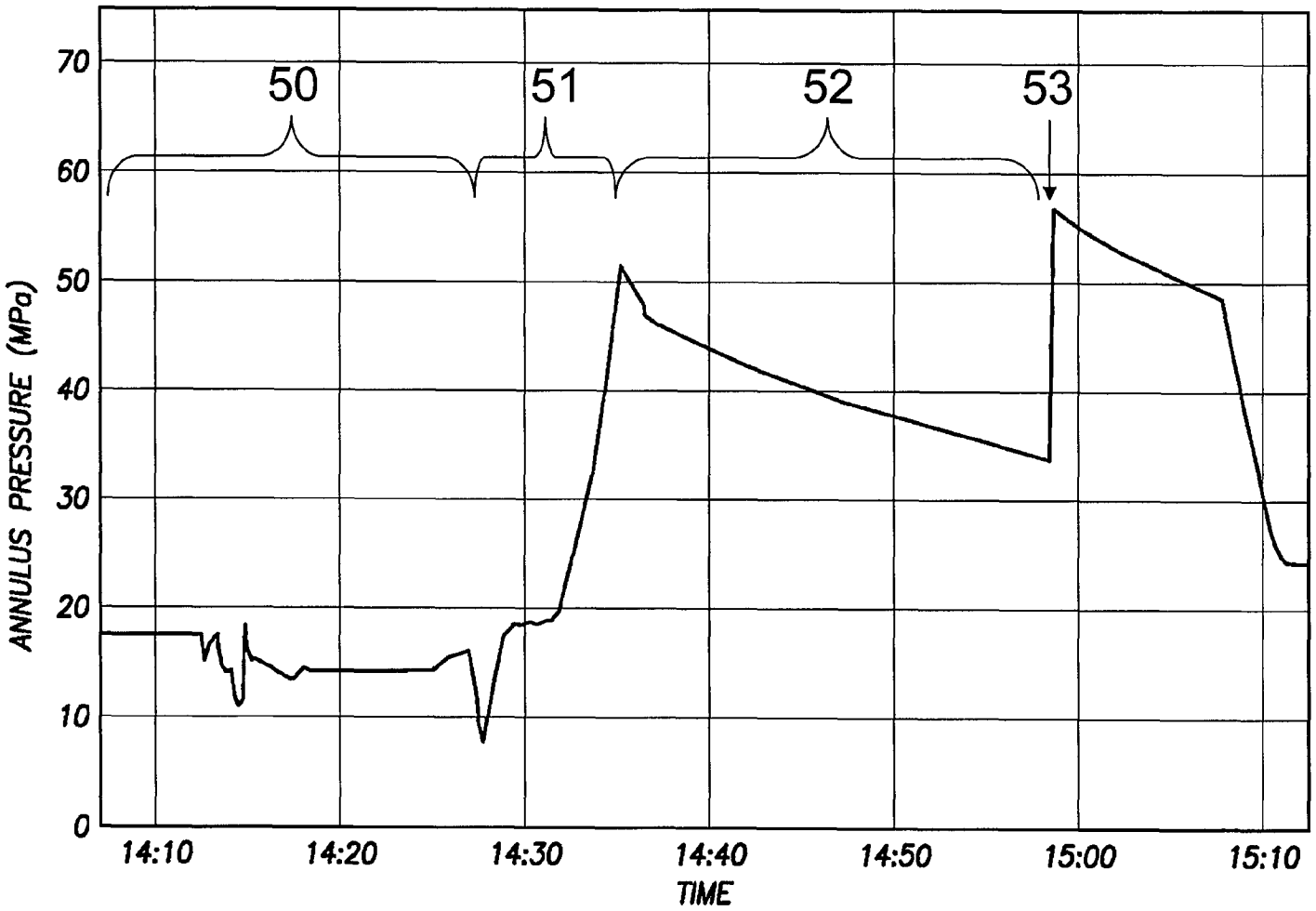
FIG. 6 illustrates exemplary behavior of fluid pressure in the annulus over time in an embodiment of the present invention.

As illustrated in FIG. 6, an embodiment of the present invention may provide formation of a particulate plug in a horizontal well bore. In this exemplary embodiment, the fluid pressure in the annulus is measured over time. As a particulate slurry is pumped into the well bore, the pressure in the annulus remains relatively steady at 50. The pumping rate is reduced at 51 to provide particulate deposition, resulting in immediate reduction in the fluid pressure. Continued, low-rate pumping results in bridging, thereby substantially increasing the fluid pressure. Pumping is ceased at 52 to allow leak-off and plug consolidation. Gradual reduction of fluid pressure can be seen during leak-off. Finally, the plug can be tested with high-rate pumping at 53. A spike in the fluid pressure indicates that a durable particulate plug has formed.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Moreover, the indefinite articles "a" or "an," as used in the claims, are defined herein to mean one or more than one of the element that it introduces. Also, the terms in the claims have their plain, ordinary meaning unless otherwise explicitly and clearly defined by the patentee.

What is claimed is:

1. A method of setting a particulate plug within an at least partially horizontal section of a well bore, comprising the steps of:

selecting a deposition location for the particulate plug within the at least partially horizontal section of the well bore having a proppant bed therein;

providing a pumping conduit capable of delivering slurries to the deposition location;

pumping a first slurry through the pumping conduit to the deposition location such that a velocity of the first slurry in the well bore at the deposition location is less than or equal to the critical velocity of the first slurry in the well bore with the proppant bed at the deposition location.

2. The method of claim 1, wherein particulate deposition within the pumping conduit does not exceed about 20% of the internal diameter of the pumping conduit.

3. The method of claim 2, wherein pumping continues at least until a bridge forms proximate the deposition location.

4. The method of claim 1, further comprising the steps of:

pumping a second slurry through the pumping conduit to the deposition location such that a velocity of the second slurry in the well bore at the deposition location is less than or equal to the critical velocity of the second slurry in the well bore with any previous deposition at the deposition location; and successively pumping subsequent slurries through the pumping conduit to the deposition location such that, for each subsequent slurry, a velocity of each subsequent slurry in the well bore at the deposition location is less than or equal to the critical velocity of such slurry in the well bore with any previous deposition at the deposition location; wherein the pumping of subsequent slurries continues at least until a bridge forms proximate the deposition location.

5. The method of claim 1, wherein the first slurry comprises:

a base fluid; and particulate, wherein the particulate comprises at least one material selected from the group consisting of: a common sand, a resin-coated particulate, a sintered bauxite, a silica alumina, a glass, a fiber, a ceramic material, a polylactic acid material, a composite material, and a derivative thereof.

6. The method of claim 5, wherein the concentration of particulate in the first slurry is between about 1 and about 25 lbs/gal.

7. The method of claim 1, wherein the first slurry is a low viscosity fluid.

8. The method of claim 1, wherein the pumping conduit comprises coiled tubing.

9. The method of claim 1, wherein the well bore is at least partially cased proximate the deposition location.

10. A method of treating a subterranean formation comprising the steps of:

(a) selecting a treatment zone in the subterranean formation;

(b) providing a treatment fluid comprising proppant to the treatment zone through a well bore, wherein: the well bore penetrates the treatment zone; and at least a section of the well bore is at least partially horizontal proximate the treatment zone; and at least some of the proppant forms a proppant bed at the deposition location;

(c) providing a pumping conduit capable of delivering slurries to a deposition location within the well bore proximate the treatment location; and (d) pumping a first slurry through the pumping conduit to the deposition location such that a velocity of the first slurry in the well bore at the deposition location is less than or equal to the critical velocity of the first slurry in the well bore at the deposition location and the velocity of the first slurry in the well bore at the deposition location is less than or equal to the critical velocity of the first slurry in the well bore with the proppant bed at the deposition location.

11. The method of claim 10, wherein the well bore is at least partially cased proximate the deposition location.

12. The method of claim 10, wherein particulate deposition within the pumping conduit does not exceed about 20% of the internal diameter of the pumping conduit.

13. The method of claim 12, wherein pumping continues at least until a bridge forms proximate the deposition location.

14. The method of claim 13, wherein steps (a)-(d) are repeated in a subsequent treatment zone.

15. The method of claim 10, further comprising the steps of:

pumping a second slurry through the pumping conduit to the deposition location such that a velocity of the second slurry in the well bore at the deposition location is less than or equal to the critical velocity of the second slurry in the well bore with any previous deposition at the deposition location; and successively pumping subsequent slurries through the pumping conduit to the deposition location such that, for each subsequent slurry, a velocity of each subsequent slurry in the well bore at the deposition location is less than or equal to the critical velocity of such slurry in the well bore with any previous deposition at the deposition location; wherein the pumping of subsequent slurries continues at least until a bridge forms proximate the deposition location.

16. The method of claim 10, wherein the first slurry comprises a base fluid; and particulate, wherein the particulate comprises at least one material selected from the group consisting of a common sand, a resin-coated particulate, a sintered bauxite, a silica alumina, a glass, a fiber, a ceramic material, a polylactic acid material, a composite material, and a derivative thereof.

17. The method of claim 16, wherein the concentration of particulate in the first slurry is between about 1 to about 25 lbs per gallon.

* * * * *